US008926831B2

(12) United States Patent
Bouchy et al.

(10) Patent No.: US 8,926,831 B2
(45) Date of Patent: Jan. 6, 2015

(54) PROCESS FOR HYDRODESULPHURIZING GASOLINE EMPLOYING A CATALYST WITH CONTROLLED POROSITY

(75) Inventors: Christophe Bouchy, Lyons (FR); Nathalie Marchal, Saint Genis Laval (FR); Florent Picard, Saint Symphorien D'Ozon (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 0 days.

(21) Appl. No.: 13/305,527

(22) Filed: Nov. 28, 2011

(65) Prior Publication Data

US 2012/0067780 A1 Mar. 22, 2012

Related U.S. Application Data

(63) Continuation of application No. 11/171,287, filed on Jul. 1, 2005, now abandoned.

(51) Int. Cl.

| | |
|---|---|
| ***C10G 65/04*** | (2006.01) |
| ***C10G 45/04*** | (2006.01) |
| ***C10G 45/08*** | (2006.01) |

(52) U.S. Cl.

CPC ..... *C10G 45/04* (2013.01); *C10G 45/08* (2013.01); *C10G 2400/02* (2013.01); *C10G 2300/1044* (2013.01); *C10G 2300/202* (2013.01)

USPC ..... 208/210; 208/216 R; 208/216 PP

(58) Field of Classification Search

USPC ..... 208/210, 216 R, 216 PP

See application file for complete search history.

(56) References Cited

U.S. PATENT DOCUMENTS

| | | | | |
|---|---|---|---|---|
| 5,287,708 | A | 2/1994 | Hiramatsu et al. | |
| 5,423,975 | A * | 6/1995 | Sudhakar et al. | 208/216 R |
| 5,837,637 | A * | 11/1998 | Reeg et al. | 208/164 |
| 6,132,597 | A * | 10/2000 | Harle et al. | 208/213 |
| 6,231,753 | B1 * | 5/2001 | McKnight et al. | 208/217 |
| 6,435,273 | B1 | 8/2002 | Futermik et al. | |
| 6,793,016 | B2 | 9/2004 | Aoki et al. | |
| 6,938,431 | B2 | 9/2005 | Hanada | |
| 7,069,938 | B2 | 7/2006 | Yen et al. | |
| 7,754,068 | B2 * | 7/2010 | Menegassi De Almeida et al. | 208/216 R |
| 2003/0150594 | A1 | 8/2003 | Futermik et al. | |

FOREIGN PATENT DOCUMENTS

| | | | |
|---|---|---|---|
| GB | 2106535 A | * | 4/1983 |
| WO | WO-02/062928 | | 8/2002 |

* cited by examiner

*Primary Examiner* — Randy Boyer

(74) *Attorney, Agent, or Firm* — Millen, White, Zelano & Branigan, P.C.

(57) ABSTRACT

A novel process is described which allows selective hydrodesulphurizing gasoline cuts containing sulphur-containing compounds and olefins. The process employs a catalyst comprising a support selected, for example, from refractory oxides such as aluminas, silicas, silica-aluminas or magnesia, used alone or as a mixture, a group VI metal, preferably Mo or W which may or may not be promoted by a group VIII metal, Co or Ni. The catalyst is characterized by a mean pore diameter of more than 22 nm. The process may comprise one or more steps.

13 Claims, No Drawings

PROCESS FOR HYDRODESULPHURIZING GASOLINE EMPLOYING A CATALYST WITH CONTROLLED POROSITY

This application is a continuation of U.S. patent application Ser. No. 11/171,287, filed Jul. 1, 2005 now abandoned, which is incorporated by reference herein.

The present invention relates to a desulphurization process employing a catalyst containing at least one support, and an active phase comprising a metal, for example. The process allows hydrodesulphurizing gasoline, more particularly gasoline from a catalytic cracking process (fluid catalytic cracking, FCC).

The production of reformulated gasoline satisfying new environmental regulations primarily necessitates substantially reducing their sulphur content. Current and future environmental regulations within the European community require refiners to reduce the sulphur content in the gasoline pool to values of 50 ppm or less by 2005 and 10 ppm by 1, Jan. 2009. The feed to be treated is generally a gasoline cut containing sulphur, such as a cut from coking, visbreaking, steam cracking or catalytic cracking (FCC). That feed is preferably constituted by a gasoline cut derived from a catalytic cracking unit with a typical boiling point range which extends from that of hydrocarbons containing 5 carbon atoms to about 250° C. Said gasoline may optionally be composed of a significant fraction of gasoline from other production processes, such as atmospheric distillation (generally termed straight run gasoline by the refiner) or conversion processes (cooker gasoline or steam cracked gasoline).

Catalytically cracked gasoline, which may constitute 30% to 50% by volume of the gasoline pool, has high olefin and sulphur contents. Almost 90% of the sulphur present in reformulated gasoline is due to gasoline derived from catalytic cracking. Desulphurizing gasoline, and principally of FCC gasoline, is thus clearly important in order to satisfy requirements. Hydrotreatment or hydrodesulphurizing catalytically cracked gasoline, carried out under conventional conditions known to skilled person, can reduce the sulphur content in the cut. However, that process suffers from the major disadvantage of causing a very large drop in the octane number of the cut due to hydrogenation or saturation of a major portion or even all of the olefins under the hydrotreatment conditions. Thus, processes that can deep desulphurize FCC gasoline while keeping the octane number to an acceptable level have been proposed. U.S. Pat. No. 5,318,690 proposes a process consisting of fractionating the gasoline, sweetening the light fraction and hydrotreating the heavy fraction over a conventional catalyst then processing it over a ZSM-5 zeolite to recover the initial octane number. International patent WO-A-01/40409 claims the treatment of FCC gasoline at high temperature, low pressure and with a high hydrogen/feed ratio. Under those particular conditions, recombination reactions, employing the $H_2S$ formed by the desulphurization reaction and olefins, resulting in the formation of mercaptans, are minimized.

The desired improvement in the reaction selectivity (hydrodesulphurization/hydrogenation) may thus be obtained by the choice of process, but in all cases, the use of an intrinsically selective catalytic system is imperative. In general, the catalysts used for this type of application are sulphide type catalysts containing a group VIB element (Cr, Mo, W) and a group VIII element (Fe, Ru, Os, Co, Rh, Ir, Pd, Ni, Pt).

Obtaining selective catalysts for selective hydrodesulphurizing olefinic gasoline cuts has been disclosed in many patents. Certain patents propose the use of supports other than the alumina support conventionally used for hydrotreatment catalysts, such as supports based on magnesia (U.S. Pat. No. 4,203,829; U.S. Pat. No. 4,140,626), spinel (U.S. Pat. No. 5,525,211), carbon (U.S. Pat. No. 5,770,046), hydrotalcite (U.S. Pat. No. 5,340,466). Other patents claim the use of a catalyst with a controlled mesoporosity such as U.S. Pat. No. 6,013,598 which claims the use of a catalyst with a median pore diameter (measured by mercury porismetry) in the range 7.5 to 17.5 nm. Despite these advances, the development of novel catalysts with improved selectivities remains an important objective in the field of hydrotreating cracked gasoline.

To be competitive, hydrodesulphurization processes must satisfy two principal constraints, namely:

- limited olefin hydrogenation at high degrees of desulphurization;
- good catalytic system stability and continuous operation over several years.

Further, to carry out deep desulphurization, it is necessary to treat all of the sulphur-containing compounds present in the cracked gasoline and in this context, catalytically cracked gasoline can be classified into two families:

- unsaturated sulphur-containing compounds, namely thiophene, methylthiophenes, dimethylthiophenes, ethylthiophenes, other alkylthiophenes, benzothiophenes and alkylbenzothiophenes;
- saturated sulphur-containing compounds, namely mercaptans, cyclic or aliphatic sulphides, disulphides.

The residual sulphur-containing compounds present in gasoline desulphurized by deep hydrodesulphurization comprise recombination mercaptans derived from the addition of $H_2S$ formed during the reaction to the olefins present and to unsaturated sulphur-containing compounds such as thiophene and alkylthiophenes. The presence of recombination mercaptans at least in part explains why, when seeking to deep desulphurize gasoline comprising an olefin fraction, a major increase in the degree of olefin hydrogenation is observed for high degrees of desulphurization. Thus, when the desired degree of desulphurization approaches 100%, the degree of olefin saturation is greatly increased. The use of more selective catalysts may, however, when degrees of desulphurizing close to 100% are desired, limit olefin hydrogenation or allow the formation of recombination mercaptans. One of the primary aims of deep desulphurization is thus to develop processes that can attain high selectivities, i.e. minimize olefin hydrogenation reactions while treating residual sulphur-containing compounds such as mercaptans.

Of the solutions which may be envisaged to reach the degrees of desulphurization imposed by current or future regulations, it may be advantageous to use desulphurization in at least two steps.

European patent EP-A1-1 031 622 discloses a process for desulphurizing olefinic gasoline comprising at least two steps, a step for hydrogenation of unsaturated sulphur-containing compounds and a step for decomposition of saturated sulphur-containing compounds. As described in that patent, the invention is based on a combination of two steps in which the first step eliminates unsaturated sulphur-containing compounds to saturated sulphur-containing compounds and the second step decomposes saturated sulphur-containing compounds to $H_2S$ with limited olefin hydrogenation.

U.S. Pat. No. 6,231,753 describes a process for hydrodesulphurizing olefinic gasoline comprising a first hydrodesulphurization step, a step for extracting $H_2S$ and a second hydrodesulphurization step, the overall degree of desulphurization and the temperature of said second step being greater than those of the first.

U.S. Pat. No. 6,231,754 describes a process in which a used hydrotreatment catalyst is then used in a hydrodesulphurization step at a higher temperature. The pore diameters of the catalyst are described as being in the range 6 to 20 nm and the surface concentration of $MoO_3$ is in the range $0.5\times10^{-4}$ to $3\times10^{-4}$ g/m$^2$.

International patent application WO-A-03/099963 describes a process in two steps in which the second step is carried out with a catalyst which is less loaded with metals and has a pore diameter that is greater than or equal to the catalyst used during the first step. The mean pore diameter is in the range 6 to 20 nm and the surface concentration of $MoO_3$ is in the range $0.5\times10^{-4}$ to $3\times10^{-4}$ g/m$^2$.

SUMMARY OF THE INVENTION

The present invention describes a process that can reduce the total sulphur content of hydrocarbon cuts and preferably FCC gasoline cuts without losing the gasoline yield and minimizing the reduction in octane number.

The process for hydrodesulphurizing a gasoline of the invention employs a catalyst comprising a support and an active phase comprising at least one metal, characterized in that the mean pore diameter of said catalyst is more than 20 nanometers, preferably in the range 20 to 100 nm.

Preferably, the catalyst of the invention contains at least one group VI metal; more preferably it also contains at least one group VIII metal. The surface density of the group VI metal is preferably in the range $2\times10^{-4}$ to $40\times10^{-4}$ grams of the oxide of said metal per m$^2$ of support.

In the process of the invention, the support is preferably selected from the group constituted by aluminas, silica, silica aluminas and oxides of titanium or magnesium, used alone or mixed with alumina or silica alumina. More preferably, the support is at least partially constituted by an alumina. In a variation of the invention, the specific surface area of the support is less than 200 m$^2$/g.

In a preferred variation, the hydrodesulphurization process of the invention comprises at least two successive hydrodesulphurization steps and a catalyst with a mean pore diameter of more than 20 nanometers is employed in at least one of said steps. Preferably, the successive steps are carried out without intermediate degassing.

In accordance with one implementation of the process of the invention, it comprises a succession of hydrodesulphurization steps and the activity of a catalyst in a step n+1 is in the range 1% to 90% of the activity of the catalyst in step n.

In accordance with a further implementation of the process of the invention, the reaction temperature in step n+1 is higher than that in step n. In accordance with a further implementation, the catalyst of step n+1 is the catalyst of step n which has undergone partial deactivation. In this case, for example, the catalyst may be deactivated by bringing the catalyst into contact with a feed containing a hydrocarbon fraction comprising olefins at a temperature of at least 250° C. It is also possible to recycle the catalyst of step n to step n+1 when its activity has reduced by at least 10%. A further possibility is that the catalyst of step n+1 has a metals content which is lower than that of the catalyst of step n.

DETAILED DESCRIPTION OF THE INVENTION

The process of the invention employs at least one hydrodesulphurization catalyst comprising at least one group VI metal ($M_{VI}$) and/or at least one group VIII metal ($M_{VIII}$) on a support. The group VI metal is generally molybdenum or tungsten; the group VIII metal is generally nickel or cobalt. The catalyst support is normally a porous solid selected from the group constituted by aluminas, silicon carbide, silica, silica-aluminas or titanium or magnesium oxides used alone or mixed with alumina or silica-alumina. It is preferably selected from the group constituted by silica, the transition alumina family and silica-aluminas. Highly preferably, the support is essentially constituted by at least one transition alumina, i.e. it comprises at least 51% by weight, preferably at least 60% by weight, more preferably at least 80% by weight or even at least 90% by weight of transition alumina. It may optionally be constituted solely by a transition alumina.

The specific surface area of the support is generally less than 200 m$^2$/g, usually less than 150 m$^2$/g. The porosity of the catalyst prior to sulphurization is such that it has a mean pore diameter of more than 20 mm, preferably more than 25 nm or even more than 30 nm and usually in the range 20 to 140 nm, preferably in the range 20 to 100 nm, and highly preferably in the range 25 to 80 nm. The pore diameter is measured by mercury porosimetry using ASTM D4284-92 with a wetting angle of 140°.

The surface density of the group VI metal in accordance with the invention is in the range $2\times10^{-4}$ to $40\times10^{-4}$ grams of the metal oxide per m$^2$ of support, preferably in the range $4\times10^{-4}$ to $16\times10^{-4}$ g/m$^2$.

According to the invention, the molar ratio $M_{VIII}/(M_{VI}+M_{VIII})$ is typically more than 0.1, preferably in the range 0.2 to 0.6 and highly preferably in the range 0.2 to 0.5.

The catalyst of the invention may be prepared using any technique which is known to the skilled person, in particular by impregnating group VIII and VIB elements onto the selected support. Impregnation may, for example, be carried out using the procedure known to the skilled person as dry impregnation, in which the exact quantity of the desired elements required to fill the pores of the support as precisely as possible is introduced in the form of soluble salts in the selected solvent, for example demineralized water. The support thus filled with solution is then preferably dried. The preferred support is alumina, which may be prepared from any type of precursor and forming tool that is known to the skilled person.

After introducing the group VIII and VIB elements, and optional forming of the catalyst, it undergoes an activation treatment. Said treatment is generally aimed at transforming the molecular precursors of the elements into the oxide phase. In this case, it is an oxidizing treatment, but direct reduction or even simply drying the catalyst may also be carried out. In the case of an oxidizing treatment, also known as calcining, this is generally carried out in air or diluted oxygen, and the treatment temperature is generally in the range 200° C. to 550° C., preferably in the range 300° C. to 500° C. In the case of a reducing treatment, this is generally carried out in pure hydrogen or, as is preferable, is diluted, and the treatment temperature is generally in the range 200° C. to 600° C., preferably in the range 300° C. to 500° C.

Examples of salts of group VIB and VIII metals which can be used in the process for preparing the catalyst are cobalt nitrate, nickel nitrate, ammonium heptamolybdate and ammonium metatungstate. Any other salt which is known to the skilled person, has sufficient solubility and can decompose during the activation treatment may be used.

The catalyst is normally used in the sulphide form obtained after treatment at temperature in contact with an organic sulphur-containing compound which is decomposable and which can generate $H_2S$ or directly in contact with a gaseous stream of $H_2S$ diluted in $H_2$. This step may be carried out in situ or ex situ (inside or outside) the hydrodesulphurization reactor at temperatures in the range 200° C. to 600° C. and more preferably in the range 300° C. to 500° C.

The present invention also pertains to a process for desulphurizing gasoline comprising olefins, comprising at least two hydrodesulphurization steps and intended to minimize both the amount of the compounds most refractory to hydrodesulphurization, such as thiophenes and recombination mercaptans, derived from adding $H_2S$ to olefins while limiting the degree of olefin hydrogenation, associated with elimination of sulphur-containing compounds. At least one of the steps in the hydrodesulphurization process employs a catalyst as described above.

At least partial extraction of $H_2S$ between the two reactors using any means known to the skilled person is a known solution for achieving high degrees of desulphurization with a limited degree of olefin hydrogenation. In one possible implementation, that type of scheme may be applied in the context of the present invention. However, since an $H_2S$ extraction step involves an extra cost in the process, the present process is of particular advantage in the case in which the hydrodesulphurization reactors are concatenated without $H_2S$ elimination between the reactors.

The process comprises at least two steps. A first step A for hydrodesulphurization is preferably carried out in a fixed bed reactor, generally in the vapour phase, on any catalyst which is conventionally used for said application. The use of "selective" catalysts is preferred as they can limit olefin hydrogenation while maximizing hydrodesulphurization. This first step is followed by a second step B, for example with no operations between steps A and B apart from reheating the effluent from step A. Step B is characterized in that it is carried out using a catalyst having a catalytic activity for thiophene conversion in the range 1% to 90%, or even in the range 1% to 70% and preferably in the range 1% to 50% of the activity of the catalyst of step A. The catalyst employed in step B may be either a catalyst the catalytic formulation of which has been optimized to reach the desired catalytic activity, or a partially deactivated catalyst.

In accordance with the invention, the use of catalysts which are preferably more selective in series can limit olefin hydrogenation at high degrees of desulphurization. It has been observed that such a combination may, by means of a cheaper device, significantly improve the selectivity of the desulphurization reaction by minimizing the degree of olefin saturation while maintaining a high degree of transformation of sulphur-containing compounds to $H_2S$. That device also has the advantage that, for a scheme with no $H_2S$ extraction between the two reactors, it can improve the selectivity of the process with respect to desulphurization carried out in a single step. Compared with the disclosure in EP-A1-1 031 622, carrying out the present process can achieve higher degrees of desulphurization for the same degree of olefin hydrogenation as the unsaturated compounds which are not converted in the first step may be converted in the second step.

In the particular case in which the catalyst of step B is the same catalyst as that of step A, but with a catalytic activity which has been reduced by deactivation, the device is usually based on an assembly of at least two or even three reactors and may be carried out as follows: the reactor for step A contains fresh catalyst and the reactor for step B contains the used catalyst. When the catalyst of step A is deactivated, the reactor containing the deactivated step A catalyst is used in the second step, a reactor containing fresh catalyst being fired up and placed at step A. The reactor containing catalyst B is stopped, the catalyst is replaced with fresh catalyst and the reactor is placed on standby. This scheme means that the desulphurization unit can be operated continuously when replacing used catalyst while maximizing process selectivity.

This implementation is particularly advantageous when operating the hydrodesulphurization section at low pressures and high temperatures for the two steps, conditions under which the formation of recombination mercaptans is minimized but which causes rapid deactivation of the hydrodesulphurization catalysts. The term "low pressure" means relative pressures that are generally less than 2 MPa relative and preferably less than 1.5 MPa relative or even less than 1 MPa relative, and temperatures that are generally more than 250° C. or even 260° C. and usually more than 280° C.

Step A is generally characterized by:

- a degree of desulphurization which is generally less than 98%, preferably less than 95% and more preferably less than 90%;
- a degree of olefin hydrogenation which is less than 60% and preferably less than 50%.

Step B is usually characterized by:

- a degree of desulphurization which is generally less than 98%, preferably less than 95% and more preferably less than 90%;
- a degree of olefin hydrogenation which is less than 60% and preferably less than 50%;
- an operating temperature which is higher than that of step A, preferably higher by more than 10° C. than the temperature in step A and more preferably higher by more than 20° C. than the temperature in step A;
- the use of a catalyst the activity per unit volume of which, measured by thiophene conversion, is in the range 1% to 90% of the activity of the catalyst of step A. Said catalytic activity is measured using a model molecule test described below.

The pressure in steps A and B is generally in the range 0.4 MPa relative to 3 MPa relative, preferably in the range 0.6 MPa to 2.5 MPa; the hydrogen flow rate is such that the ratio of the flow rates of hydrogen in normal liters per hour to the flow rate of hydrocarbons in liters per hour is in the range 50 to 800, preferably in the range 60 to 600. The temperature in step A is in the range 150° C. to 450° C., preferably in the range 200° C. to 400° C. and more preferably in the range 230° C. to 350° C. and the temperature in step B is in the range 150° C. to 450° C., preferably in the range 210° C. to 410° C. and more preferably in the range 240° C. to 360° C.

Steps A and B are carried out in a preferred mode in a combination without a supplemental intermediate step. Thus, it is possible to employ them in the same reactor. In this case, the catalytic zone corresponding to step B is operated at a mean temperature that is higher by a minimum of 10° C. than in the catalytic zone corresponding to step A. This difference in temperature may derive either from the heat of reaction released by olefin hydrogenation or by injecting a hotter fluid selected from hydrogen or an inert gas such as nitrogen, the feed or the fluid derived from recycling a fraction of the effluent of the process between the catalytic zones A and B.

Steps A and B may also be employed in a catalytic column from which overhead compounds which are gaseous under normal temperature and pressure conditions are extracted. In this case, the catalytic zone of step A is disposed higher in the column than the catalytic zone of step B.

The catalyst of step B advantageously differs from the catalyst of step A by a catalytic activity in the range 1% to 90%, or even in the range 1% to 70% and preferably in the range 1% to 50% of the catalytic activity of the catalyst of step A. the catalysts for steps A and B are used in the sulphurized form. The sulphurization procedure may be carried out in situ or ex situ using any sulphurization method known to the skilled person.

The activity of the catalyst is defined by the ratio of the rate constant for conversion of normalized thiophene per volume of catalyst determined during a model molecule test. The rate constant is calculated by assuming that the following reaction is 1st order:

$$A=k/(m_{catalyst}\times CPD_{catalyst})$$

in which:

A: activity of catalyst in $min^{-1}\cdot cm^{3}_{catalyst}{}^{-1}$ (cubic centimeter$^{-1}$)

k: rate constant for thiophene conversion, in $min^{-1}$;

$m_{catalyst}$: mass of catalyst used in g;

CPD: packed catalyst density, in $cm^3/g$.

When the catalyst used is a new catalyst prepared to have a reduced activity, new catalyst may be prepared by impregnating a small quantity of metals onto the support. Typically, the amounts of group VIII and group VIB metals deposited on the support will not exceed 10.9% and 14% by weight respectively in the oxide form and preferably 7.8% and 10% by weight respectively in the oxide form (to remain coherent with the maximum Co/Co+Mo ratio of 0.6 for the preferred range). The support used generally contains silicon, silicon carbide, titanium oxide or magnesium oxide and/or alumina, but is preferably mainly composed of alumina.

The catalyst of step B may also be a deactivated hydrotreatment catalyst. As an example, a used catalyst from a distillate hydrodesulphurization unit or from any other hydrodesulphurization process present in the refinery may be employed, provided that the residual activity measured by the method described in Example 6 does not exceed 90% or 70% and preferably 50% of the activity of the catalyst from step A.

Finally, the catalyst of step B can have an identical formulation to that of step A, but after having undergone deactivation by treatment of a cut comprising olefins. The used catalysts generally have an activity reduced by the presence of a deposit of carbon due to polymerization of the hydrocarbons treated over the catalyst.

The present invention may be implemented as follows: the gasoline to be treated is, for example, characterized by a sulphur content of more than 50 ppm and an olefins content of more than 10%; at least 70% of the sulphur is intended to be converted into $H_2S$. This gasoline, which has boiling points which are generally less than 250° C., may either be treated directly using the device of the present invention, or it can undergo pretreatment consisting of a selective hydrogenation step and fractionation. Said pretreatments are described in detail in European application EP-A-0 1 077 247. In this case, advantageously only the $C_{6+}$ (i.e. containing hydrocarbons with a total number of carbon atoms of 6 or more) of the gasoline may be treated by the process of the present invention.

The gasoline, mixed with hydrogen, is heated in an exchanger train and/or an oven. The mixture, heated to the desired temperature and pressure, is generally in the vapour phase. It is sent to a first reactor (step A) containing a hydrodesulphurization catalyst as described above, used in fixed bed mode. The effluent from this reactor contains hydrocarbons and unreacted sulphur-containing compounds, paraffins derived from olefin hydrogenation, $H_2S$ from the decomposition of sulphur-containing compounds and recombination mercaptans derived from addition reactions of $H_2S$ with olefins. This effluent is generally reheated in an exchange train and/or an oven to increase its temperature by at least 10° C. and is injected into a second reactor (step B) containing a hydrodesulphurization catalyst which is less active than that described above, used in a fixed bed mode. The effluent from this reactor is constituted by hydrocarbons and a reduced quantity of sulphur-containing compounds which did not react in step A, paraffins derived from olefin hydrogenation, $H_2S$ derived from the decomposition of sulphur-containing compounds and a reduced quantity of recombination mercaptans derived from $H_2S$-olefin addition reactions.

For a given degree of desulphurization, the combination of steps A and B can, with respect to step A alone, minimize the olefin loss by hydrogenation. The examples below illustrate the advantages of the process in one or two steps as described above. In these examples (and the preceding description), the amounts of sulphur or sulphur-containing compounds are given in ppm by weight.

Example 1

Preparation of Catalysts

The catalysts were prepared using the same method. The synthesis protocol consisted of dry impregnating a solution of ammonium heptamolybdate and cobalt nitrate, the volume of the aqueous solution containing the metallic precursors being equal to the water take-up volume (WTV) corresponding to the mass of support to be impregnated.

The concentrations of precursors in the solution were adjusted to deposit the desired amounts by weight of metallic oxides onto the support. The solid was left to mature at ambient temperature for 12 hours, then dried at 120° C. for 12 hours. Finally, the solid was calcined at 500° C. for two hours in a stream of air (1 l/h/g). The alumina supports used were industrial supports provided by Axens with the characteristics shown in Table 1 below.

TABLE 1 characteristics of industrial alumina supports

| Support | Shape | $S_{BET}$ ($m^2/g$)* | $V_p$ (Hg)** cc/g |
|---|---|---|---|
| α | Beads 1.4-2.8 mm | 140 | 1.10 |
| β | Beads 1.4-2.8 mm | 80 | 1.09 |
| γ | Beads 1.4-2.8 mm | 32 | 1.06 |
| δ | Beads 1.4-2.8 mm | 210 | 0.64 |

*specific surface area measured by nitrogen adsorption (ASTM D3663);
**total Hg intrusion pore volume.

Various CoMo type catalysts were prepared on said supports. Table 2 shows that these catalysts are essentially distinguished from each other in their textural properties for catalysts A, B, C and D and by their active phase content for catalysts E and F.

TABLE 2 characteristics s of CoMo catalysts

| Catalyst | Support | CoO Wt % | $MoO_3$ Wt % | V (Hg)* cc/g | Median pore diameter**/nm |
|---|---|---|---|---|---|
| A (inv) | α | 3.5 | 10.0 | 0.99 | 22 |
| B (inv) | β | 3.5 | 9.2 | 0.87 | 54 |
| C (inv) | γ | 3.6 | 9.8 | 0.85 | 142 |
| D (comparative) | δ | 3.8 | 10.7 | 0.60 | 12 |
| E (comparative) | δ | 1.1 | 3.2 | 0.62 | 11 |
| F (inv) | β | 1.0 | 3.1 | 0.90 | 53 |

*total Hg intrusion pore volume;
**pore diameter corresponding to intrusion volume of $V_p$ (Hg)/2.

The catalyst sulphurization protocol was identical for each catalytic test. The catalyst, in its calcined (oxide) form, was loaded into the catalytic test unit then sulphurized using a synthetic feed (4% S in the form of DMDS in n-heptane). The sulphurization conditions were as follows: HSV=2 $h^{-1}$ (volume of feed/volume of catalyst/h), P=2 MPa relative, $H_2$/feed=300 (Nl/l), $T_{constant}$=350° C. (4 h, increase in T at 20° C./hour).

The sulphur content (in ppm) was evaluated in the feed and in the tests (after eliminating dissolved $H_2S$) using the ISO14596 method, which enabled the degree of desulphurizing the gasoline to be calculated using the formula:

$$HDS(\%)=(\text{sulphur in feed in ppm}-\text{sulphur in test in ppm})/(\text{sulphur in feed in ppm})*100.$$

The content by weight of olefins was evaluated in the feed and in the test by gas phase chromatography; this allowed the degree of olefin hydrogenation in the gasoline to be calculated using the formula:

$$HDO(\%)=(\%\text{ by weight olefins,feed}-\%\text{ by weight olefins,test})/(\%\text{ by weight of olefins,feed})*100$$

The total mercaptans content was measured in the tests by potentiometry using the ASTM D3227 method after separating the $H_2S$.

Example 2

Evaluation of Performances of Catalysts A and D

In this example, the performances of catalysts A (according to the invention) and D (comparative) were compared in selective HDS of a sulphur-containing FCC gasoline with the characteristics shown in Table 3 below.

TABLE 3 characteristics of FCC n° 1 gasoline

| | | |
|---|---|---|
| Total sulphur (ppm) | | 970 |
| Olefins (weight %) | | 35.7 |
| Aromatics (weight %) | | 27.6 |
| ASTM distillation: | IP | 37° C. |
| | EP | 215° C. |

The test conditions were as follows: P=2.7 MPa relative, HSV=4 $h^{-1}$, $H_2$/feed=360 normal liters per liter (nl/l), T=250-280° C. Each operating condition was maintained over the time required to stabilize the catalyst both as regards hydrogenating activity and desulphurizing activity (typically 24 to 48 hours). The results obtained for catalysts A and D are shown in Table 4 below.

TABLE 4 performances of catalysts A and D for desulphurizing FCC n° 1 gasoline

| | Catalyst A | | | Catalyst D | |
|---|---|---|---|---|---|
| T (° C.) | 250 | 260 | 270 | 250 | 260 |
| $S_{total}$ | 160 | 130 | 90 | 130 | 65 |
| HDS/% | 83.5 | 86.6 | 90.7 | 86.6 | 93.3 |
| Olefins, % by weight | 26.7 | 26.1 | 25.5 | 23.0 | 21.1 |
| HDO/% | 25.2 | 26.9 | 28.6 | 35.6 | 40.9 |

It will be observed that for comparable degrees of desulphurization (HDS), catalyst A has a degree of olefin hydrogenation (HDO) which is lower than for catalyst D. Catalyst A (according to the invention) was thus more selective than catalyst D (comparative).

Example 3

Evaluation of Performances of Catalysts A and B

In this example, catalysts A (according to the invention) and B (comparative) were evaluated using FCC no. 2 gasoline which contained less sulphur than FCC no. 1 gasoline, and which had the characteristics shown in Table 5 below.

TABLE 5 characteristics of FCC n° 2 gasoline

| | | |
|---|---|---|
| Total sulphur (ppm) | | 450 |
| Olefins (weight %) | | 33.5 |
| Aromatics (weight %) | | 28.2 |
| ASTM distillation: | IP | −5° C. |
| | EP | 252° C. |

The test conditions were as follows: P=1.5 MPa relative, HSV=5 $h^{-1}$, $H_2$/feed=300 Nl/l, T=270-280° C. Each operating condition was maintained over the time required to stabilize the catalyst both as regards hydrogenating activity and desulphurizing activity (typically 24 to 48 hours). The results obtained for catalysts A and B are shown in Table 6 below.

TABLE 6 performances of catalysts A and B for desulphurizing FCC n° 2 gasoline

| | Catalyst A | | Catalyst B | |
|---|---|---|---|---|
| T (° C.) | 270 | 280 | 270 | 280 |
| $S_{total}$ | 96 | 46 | 92 | 54 |
| HDS/% | 78.7 | 89.8 | 79.5 | 88.0 |
| Olefins, % by weight | 29.7 | 26.3 | 30.1 | 27.5 |
| HDO/% | 11.3 | 21.5 | 10.1 | 17.9 |

For similar degrees of desulphurization (HDS), catalyst B had a lower hydrogenating activity (HDO) than catalyst A. Catalyst B (according to the invention) was thus more selective than catalyst D (comparative).

Example 4

Evaluation of Performances of Catalysts A and C

In this example, catalysts A and C were evaluated using FCC no. 3 gasoline which had been depentanized and contained a large amount of sulphur, and which had the characteristics shown in Table 7 below.

TABLE 7 characteristics of FCC n° 3 gasoline

| | | |
|---|---|---|
| Total sulphur (ppm) | | 2450 |
| Olefins (weight %) | | 32.1 |
| Aromatics (weight %) | | 36.2 |
| ASTM distillation: | IP | 39° C. |
| | EP | 240° C. |

The test conditions were as follows: P=1.5 MPa relative, HSV=4 $h^{-1}$, $H_2$/feed=300 Nl/l, T=290-310° C. Each operating condition was maintained over the time required to stabilize the catalyst both as regards hydrogenating activity and desulphurizing activity (typically 24 to 96 hours). The results obtained for catalysts A and C are shown in Table 8 below.

TABLE 8

| performances of catalysts A and C for desulphurizing FCC n° 3 gasoline | | | | |
|---|---|---|---|---|
| | Catalyst A | | Catalyst C | |
| T (° C.) | 290 | 310 | 290 | 310 |
| $S_{total}$ | 420 | 115 | 645 | 305 |
| HDS/% | 82.9 | 95.3 | 73.7 | 87.6 |
| Olefins, % by weight | 25.0 | 19.7 | 27.1 | 23.2 |
| HDO/% | 22.1 | 38.6 | 15.6 | 27.7 |

The change in the degree of olefin hydrogenation as a function of the degree of desulphurization shows that the two catalysts had comparable selectivities. Thus, catalyst C is not more selective than catalyst A. In contrast, catalyst C was less active than catalyst A in hydrodesulphurization, which may potentially constitute a handicap as regards the service life of this type of catalyst in an industrial unit. Regarding selectivity, catalyst C remained superior to catalyst D, however (see Example 2, Table 4),

Example 5

Preparation of a Partially Deactivated Catalyst G

A sample of 100 ml of catalyst B underwent accelerated deactivation on a pilot unit under the following conditions: the catalyst was operated at 300° C. with a mixture constituted of gasoline 4 described in Example 6 and hydrogen injected in an amount of 100 normal liters of hydrogen per liter of gasoline, with a gasoline flow rate of 400 ml/h and at a total pressure of 1 MPa relative. After 800 hours, the reactor was put into stripping mode at 120° C. in nitrogen to eliminate adsorbed hydrocarbons. The deactivated catalyst was termed catalyst G.

Example 6

Evaluation of Catalytic Activity of Various Catalysts

The activity of catalysts B, D, E, F and G was evaluated using a hydrodesulphurization test on a mixture of model molecules carried out in a stirred 500 ml autoclave reactor. Typically, between 2 g and 6 g of catalyst were sulphurized at atmospheric pressure in a sulphurization bank with a $H_2S/H_2$ mixture constituted by 15% by volume of $H_2S$ at 1 l/l/g of catalyst and 400° C. for two hours.

The model feed used for the activity test had the following composition: 1000 ppm of sulphur in the form of thiophene, 10% by weight of olefins in the form of 2,3-dimethyl-2-butene in n-heptane.

This reaction mixture was selected as it was judged to be representative of a catalytically cracked gasoline. The total pressure of the system was then adjusted and maintained at 3.5 MPa relative by adding hydrogen and the temperature was adjusted to 250° C. At time t=0, the catalyst was brought into contact with the reaction mixture. Periodical removal of samples allowed the change in composition of the solution to be monitored over time by gas chromatographic analysis. The test period was selected so as to obtain final thiophene conversion values in the range 50% to 90%.

The activity of a catalyst can be defined by the ratio of the rate constant for conversion of normalized thiophene per volume of catalyst. The rate constant is calculated by assuming that the following reaction is $1^{st}$ order:

$$A=k/(m_{catalyst}\times CPD_{catalyst})$$

In which:

A: activity of catalyst in $min^{-1}\cdot cm^3{}_{catalyst}{}^{-1}$ (cubic centimeter$^{-1}$)

k: rate constant for thiophene conversion, in $min^{-1}$;

$m_{catalyst}$: mass of catalyst used in g (before sulphurizing);

CPD: packed catalyst density, in $cm^3/g$.

The relative activities of catalysts B, D, E and F obtained are shown in Table 9 below.

TABLE 9

| relative activities of catalysts B, D, E, F and G | | | | | |
|---|---|---|---|---|---|
| | Catalyst B | Catalyst D | Catalyst E | Catalyst F | Catalyst G |
| Relative activity | 100* | 120 | 42 | 31 | 45 |

*base.

Example 7

Evaluation of Performances of Catalysts B, D, E, F and G in Combinations

Gasoline no. 4 described in Table 10 was used to study the performance of a combination of catalysts. This gasoline derived from a FCC unit and had been depentanized.

TABLE 10

| characteristics of FCC n° 4 gasoline | | |
|---|---|---|
| Total sulphur (ppm) | | 380 |
| Olefins (weight %) | | 27.8 |
| Olefins (weight %) | | 32.1 |
| Aromatics (weight %) | | 33.9 |
| ASTM distillation: | IP | 55° C. |
| | EP | 219° C. |

The combination tests were carried out in a pilot unit provided with two reactors in series, each loaded with 100 ml of catalyst.

The performances of the various combinations of catalysts were evaluated to illustrate the present invention. For each catalyst, a conventional sulphurization procedure was carried out in advance, which procedure was identical for all of the catalysts.

The base operating conditions used for the set of tests were as follows: a pressure of 1.8 MPa relative and a hydrogen to feed ratio of 400 normal liters per liter.

The temperatures were adjusted to achieve a target sulphur content in the range 10 ppm to 15 ppm. Table 11 below summarizes the performances of the various combinations under evaluation.

TABLE 11

| Performances of catalysts alone or in combinations for desulphurizing FCC n° 4 gasoline | | | | | | | |
|---|---|---|---|---|---|---|---|
| | Test no | | | | | | |
| | 1 | 2 | 3 | 4 | 5 | 6 | 7 |
| Catalysts | B | D | D + E | B + E | B + F | B + G | B + D |
| Temp R1 | 28 | 27 | 275 | 280 | 280 | 280 | 280 |
| Temp R2 | — | — | 300 | 300 | 300 | 300 | 275 |
| HSV R1 ($h^{-1}$) | 4 | 4 | 8 | 8 | 8 | 8 | 8 |
| HSV R2 | — | | 8 | 8 | 8 | 8 | 8 |

TABLE 11-continued

| Performances of catalysts alone or in combinations for desulphurizing FCC n° 4 gasoline | | | | | | | |
|---|---|---|---|---|---|---|---|
| | Test no | | | | | | |
| | 1 | 2 | 3 | 4 | 5 | 6 | 7 |
| ($h^{-1}$) Overall HSV ($h^{-1}$) | 4 | 4 | 4 | 4 | 4 | 4 | 4 |
| S effluent, pm | 12 | 13 | 14 | 13 | 15 | 12 | 13 |
| Mercaptans, ppm | 9 | 10 | 7 | 8 | 8 | 7 | 10 |
| HDO, % | 28 | 32 | 24.5 | 21 | 20.1 | 21.4 | 30.6 |

The two reactors, placed in series, were respectively termed reactor 1 and reactor 2. The volume of catalyst in each reactor was 100 ml.

Tests 1 and 2 were carried out on catalysts B and D alone. Catalyst D was not in accordance with the invention. The olefin loss during test 1 was lower than the olefin loss in test 2 due to the difference in selectivity between catalysts B and D.

The use of catalysts E, F or G in a combination with catalysts B or D (tests, 4, 5 and 6 in accordance with the invention) improved the overall selectivity. In fact, for close sulphur contents in the tests of between 12 and 15 ppm, the olefin loss measured by the HDO was reduced compared with tests 1 and 2 carried out on a single catalyst. Further, it was observed that the best results were obtained for combinations 5 and 6 in which the catalysts used in the two steps were in accordance with the invention.

Test 7 was carried out using a combination which was not in accordance with the invention, in which reactor 2 was loaded with a more active catalyst than that loaded into reactor 1. Comparing tests 3 to 6, it can be seen that an olefin loss and a higher residual mercaptans content occurred for an equivalent sulphur content in the effluents.

Comparing the tests above shows a reduction in the quantity of mercaptans in the product obtained by carrying out the process of the invention.

The invention claimed is:

1. A process for hydrodesulphurizing a gasoline, comprising at least two successive hydrodesulfurizations, each hydrodesulfurization being conducted by subjecting a gasoline feed to a catalyst, wherein at least one hydrodesulfurization employs a catalyst comprising a support and an active phase comprising nickel or cobalt and in which the mean pore diameter of said catalyst is more than 20 nanometers, wherein activity of the catalyst of a hydrodesulfurization n+1 is 30-90% of the activity of hydrodesulfurization n, in which the successive steps are carried out without intermediate degassing, in which the reaction temperature in hydrodesulfurization n+1 is higher than that hydrodesulfurization n, and in which the catalyst of hydrodesulfurization n+1 has a lower metals content than that of the catalyst of hydrodesulfurization n.

2. A process according to claim 1, in which the mean pore diameter is 20 to 100 nm.

3. A process according to claim 1, in which the catalyst contains at least one group VI metal.

4. A process according to claim 3, in which the surface density of the group VI metal is in the range $2\times10^{-4}$ to $40\times10^{-4}$ grams of the oxide of said metal per $m^2$ of support.

5. A process according to claim 1, in which the support is an alumina, silica, a silica alumina or an oxide of titanium or magnesium, used alone or as a mixture with alumina or silica alumina.

6. A process according to claim 1, in which the support is at least in part constituted by an alumina.

7. A process according to claim 1, in which the specific surface area of the support is less than 200 $m^2/g$.

8. A process according to claim 1, in which the reaction temperature of the successive steps hydrodesulfurizations is about 150° C. to about 450° C., the pressure is about 0.4 to about 3 MPa relative, and the volume ratio of hydrogen to hydrocarbons, $H_2$/HC, about 50 Nl/l to about 800 Nl/l.

9. A process according to claim 8 in which, for each step, the pressure is less than 2 MPa relative and the temperature is more than 250° C.

10. A process according to claim 1, in which the activity of the catalyst in hydrodesulfurization n+1 is 30% to 50% of the activity of the catalyst in hydrodesulfurization n.

11. A process according to claim 1, in which the catalyst of hydrodesulfurization n+1 is the catalyst of hydrodesulfurization n which has undergone partial deactivation.

12. A process according to claim 11, in which the catalyst is deactivated by bringing the catalyst into contact with a feed containing a hydrocarbon fraction comprising olefins at a temperature of at least 250° C.

13. A process according to claim 12, in which the catalyst of hydrodesulfurization n is recycled to hydrodesulfurization n+1 when its activity has reduced by at least 10%.

* * * * *

UNITED STATES PATENT AND TRADEMARK OFFICE

CERTIFICATE OF CORRECTION

PATENT NO. : 8,926,831 B2
APPLICATION NO. : 13/305527
DATED : January 6, 2015
INVENTOR(S) : Bouchy et al.

It is certified that error appears in the above-identified patent and that said Letters Patent is hereby corrected as shown below:

On the title page item [30], Insert

-- July 1, 2004 (FR) 04 07335 --

Signed and Sealed this
Twenty-eighth Day of April, 2015

Michelle K. Lee

Michelle K. Lee
*Director of the United States Patent and Trademark Office*